US012577024B2

(12) United States Patent
Krispin

(10) Patent No.: US 12,577,024 B2
(45) Date of Patent: Mar. 17, 2026

(54) DUAL-LAYERED FOOD CONTAINER

(71) Applicant: Zena Krispin, Toms River, NJ (US)

(72) Inventor: Zena Krispin, Toms River, NJ (US)

( * ) Notice: Subject to any disclaimer, the term of this patent is extended or adjusted under 35 U.S.C. 154(b) by 0 days.

(21) Appl. No.: 18/630,151

(22) Filed: Apr. 9, 2024

(65) Prior Publication Data

US 2025/0162780 A1 May 22, 2025

Related U.S. Application Data

(60) Provisional application No. 63/577,375, filed on Apr. 20, 2023.

(51) Int. Cl.

| | |
|---|---|
| ***B65D 65/40*** | (2006.01) |
| ***B65D 65/22*** | (2006.01) |
| ***B65D 65/42*** | (2006.01) |
| ***B65D 81/24*** | (2006.01) |
| ***B65D 83/08*** | (2006.01) |
| ***B65D 85/36*** | (2006.01) |
| *B65D 65/06* | (2006.01) |

(52) U.S. Cl.

CPC ..... *B65D 65/40* (2013.01); *B65D 65/22* (2013.01); *B65D 65/406* (2013.01); *B65D 65/42* (2013.01); *B65D 81/24* (2013.01); *B65D 83/08* (2013.01); *B65D 85/36* (2013.01); *B65D 65/06* (2013.01); *B65D 2565/381* (2013.01); *B65D 2581/3406* (2013.01); *B65D 2583/085* (2013.01); *B65D 2585/366* (2013.01)

(58) Field of Classification Search

CPC ..... B65D 2581/3406; B65D 2585/366

See application file for complete search history.

(56) References Cited

U.S. PATENT DOCUMENTS

| | | | | | |
|---|---|---|---|---|---|
| 3,152,694 | A * | 10/1964 | Nashed | A61F 15/002 | 206/440 |
| 4,911,938 | A * | 3/1990 | Fisher | B65D 81/3461 | 426/243 |
| 5,180,894 | A * | 1/1993 | Quick | B65D 81/3461 | 219/730 |
| 2003/0113417 | A1* | 6/2003 | Underwood | B65D 81/3446 | 426/132 |
| 2004/0074947 | A1* | 4/2004 | Hillebrand | B65D 75/42 | 228/110.1 |
| 2009/0245698 | A1* | 10/2009 | Miller | B65D 33/2508 | 383/42 |
| 2013/0064477 | A1* | 3/2013 | Vogt | B65D 75/522 | 383/203 |
| 2014/0312104 | A1* | 10/2014 | Kim | B65D 65/04 | 229/87.08 |
| 2014/0335231 | A1* | 11/2014 | Weinstein | B65D 81/3407 | 426/243 |
| 2019/0289936 | A1* | 9/2019 | Hourani | A41D 27/207 | |

(Continued)

*Primary Examiner* — Don M Anderson

(74) *Attorney, Agent, or Firm* — Joel Douglas; Thomas Ciesco

(57) ABSTRACT

A dual-layered food container including a layer of parchment paper and a layer of aluminum foil. The parchment paper is on one surface of the wrap, while the aluminum foil is on the opposite surface. This arrangement prevents the aluminum foil from directly contacting the food, thereby avoiding potential health risks associated with aluminum. The wrap can take various forms such as a pocket, bag or sheet, and can be particularly useful for triangularly shaped food items like pizza slices.

9 Claims, 4 Drawing Sheets

(56) References Cited

U.S. PATENT DOCUMENTS

| | | | | |
|---|---|---|---|---|
| 2020/0369451 | A1* | 11/2020 | Parrish | B65D 33/01 |
| 2021/0227836 | A1* | 7/2021 | Murphy | B65D 3/261 |
| 2021/0308999 | A1* | 10/2021 | Farrell | B32B 1/00 |
| 2023/0234341 | A1* | 7/2023 | Mirmesdagh | B32B 7/028 |

* cited by examiner

FIG. 4
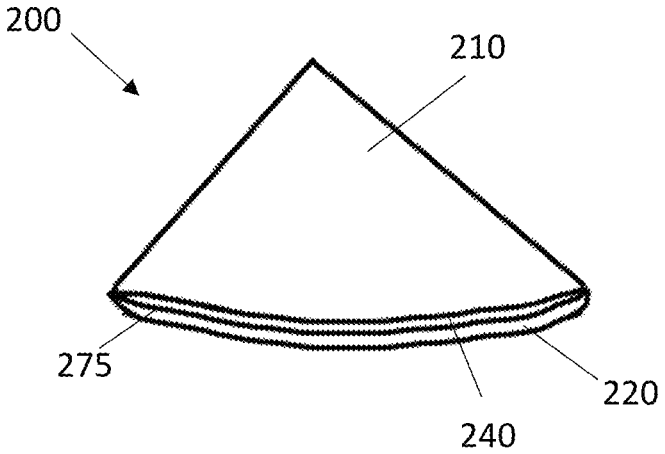
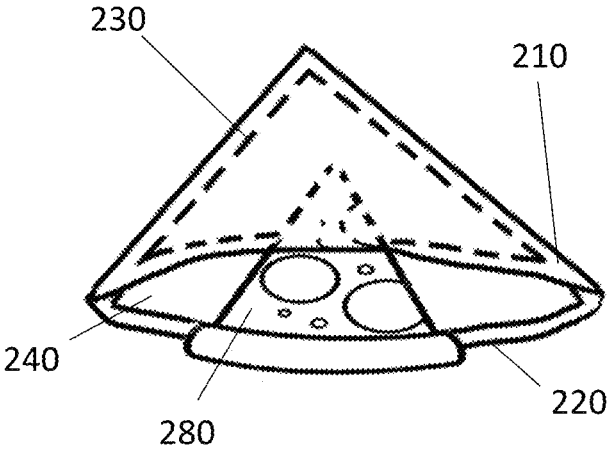
FIG. 5
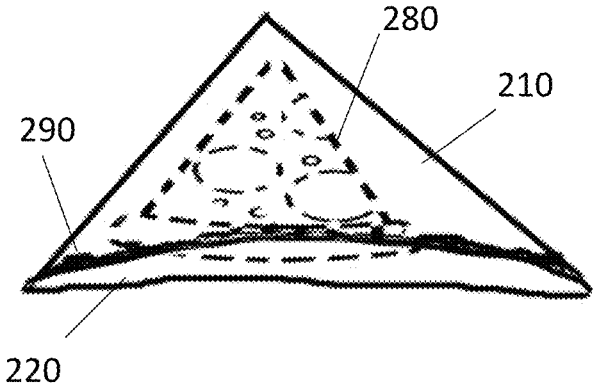
FIG.6

DUAL-LAYERED FOOD CONTAINER

COPYRIGHT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

Trademarks used in the disclosure of the invention, and the applicants, make no claim to any trademarks referenced.

CROSS-REFERENCE TO RELATED APPLICATIONS

This application is a Utility Patent application claiming priority to U.S. Provisional Patent Application Ser. No. 63/577,375, filed on Apr. 20, 2023, which is incorporated by reference herein in its entirety.

BACKGROUND OF THE INVENTION

1) Field of the Invention

The invention relates to the field of houseware, food storage, cooking enhancement, and more specifically, to food containers which maintain the freshness and taste of the food wrapped therein and to a dual-layered food containers for preservation, cooking, and reheating of prepared foods, while preventing direct contact between food and aluminum.

2) Description of Related Art

Food containers are commonly used in both commercial and home settings for the storage, preservation, and reheating of food items. They are designed to protect food from external contaminants, maintain freshness, and facilitate convenient handling. Food containers come in various forms, including sheets, rolls, bags, and pockets, and can be made from a variety of materials.

Aluminum foil is a popular material for food wraps due to its moldability and ability to form a tight seal around containers. It is often used in cooking and baking applications, as well as for food storage. Aluminum foil can effectively retain heat, making it suitable for reheating food. However, there have been concerns about the potential health risks associated with food coming into direct contact with aluminum.

Parchment paper is another commonly used material in food wraps. It is heat-resistant and non-stick, making it ideal for baking and cooking applications. Parchment paper is also used in food storage, as it can help to maintain the freshness of food items. Unlike aluminum foil, parchment paper does not pose the same health concerns when in direct contact with food.

Food containers are often designed to accommodate specific types of food items. For example, triangular-shaped food wraps may be used for pizza slices. These specialized food bags or containers provide a more secure fit and better protection for the food item. They can also offer convenience for takeout and leftover storage, potentially reducing the use of larger, more cumbersome packaging like boxes.

BRIEF SUMMARY OF THE INVENTION

The instant invention in one form is directed to a food container including an outer bag having an inner bag surface and a layer of aluminum foil disposed adjacent the inner bag surface. The aluminum foil includes a first aluminum surface contacting the outer bag and a second aluminum surface opposite the first aluminum surface. The food container includes a layer of parchment paper adjacent the second aluminum surface. The layer of aluminum foil extends beyond the layer parchment paper adjacent a top portion of the outer bag. The layer of parchment paper prevents food placed in the food container from contacting the aluminum foil during food storage. The aluminum foil may extend beyond the parchment paper adjacent a top portion of the outer bag. The layer of parchment paper may be secured to the layer of aluminum foil with a food grade adhesive. The food grade adhesive may be a water-based adhesive. The food container may include dimples disposed on portions of the parchment paper, the dimples embedded in the layer of aluminum foil for securing the layer of parchment paper to the layer of aluminum foil. The parchment paper includes a flavoring additive or a scent additive.

Another aspect of the present invention is directed to a triangular food container including an upper aluminum foil section and a lower aluminum foil section, the upper aluminum foil section secured to the lower aluminum foil section along two edges of the upper aluminum foil section and the lower aluminum foil section. The triangular food container includes an upper parchment paper section disposed adjacent an upper aluminum foil interior surface and a lower parchment paper section disposed adjacent a lower aluminum foil interior surface. The layer of aluminum foil extends beyond the layer parchment paper. The layer of parchment paper prevents food placed in the triangular food container from contacting the aluminum foil during food storage. The aluminum foil may extend beyond the parchment paper along a third edge of the upper aluminum foil section and the lower aluminum foil section. The layer of parchment paper may be secured to the layer of aluminum foil with a food grade adhesive. The food grade adhesive may be a water-based adhesive. The triangular food container may include upper dimples disposed on portions of the upper parchment paper section the upper dimples embedded in the upper aluminum foil interior surface and lower dimples disposed on portions of the lower parchment paper section the lower dimples embedded in the lower aluminum foil interior surface. The upper parchment paper section and the lower parchment paper section may include a flavoring additive or a scent additive.

Another aspect of the present invention is directed to a dual-layered food container including an upper aluminum foil section and a lower aluminum foil section, the upper aluminum foil section secured to the lower aluminum foil section along at least two edges of the upper aluminum foil section and the lower aluminum foil section. The dual-layered food container includes an upper parchment paper section disposed adjacent an upper aluminum foil interior surface and a lower parchment paper section disposed adjacent a lower aluminum foil interior surface. The dual-layered food container includes a container opening disposed along an edge portion of the upper aluminum foil section and the lower aluminum foil section. The upper aluminum foil section and the lower aluminum foil section are sealable by folding the edge portions of the upper aluminum foil section and the lower aluminum foil section together. The layer of parchment paper prevents food placed in the triangular food container from contacting the aluminum foil during food storage. The aluminum foil extends beyond the parchment paper along a third edge of the upper aluminum foil section and the lower aluminum foil section.

The layer of parchment paper is secured to the layer of aluminum foil with a food grade adhesive. Folding the third edge of the upper aluminum foil section and the lower aluminum foil section secures the dual-layered food container in a closed sealed position. The dual-layered food container may include upper dimples disposed on portions of the upper parchment paper section the upper dimples embedded in the upper aluminum foil interior surface and lower dimples disposed on portions of the lower parchment paper section the lower dimples embedded in the lower aluminum foil interior surface.

These and other objects, features, and advantages of the present invention will become more readily apparent from the attached drawings and the detailed description of the preferred embodiments, which follow.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

FIG. 4 is a top front perspective view of a second embodiment of the dual-layered container in a closed position;

FIG. 5 is a top front perspective view of the second embodiment of the dual-layered container in an open position with a prepared food shown partially inside the container;

FIG. 6 is a top front perspective view of the second embodiment of the dual-layered container with the prepared food fully wrapped in the container;

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art however that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token however, no single feature or features of any described embodiment should be considered essential to every embodiment of the invention, as other embodiments of the invention may omit such features.

In this application the use of the singular includes the plural unless specifically stated otherwise and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components including one unit and elements and components that include more than one unit, unless specifically stated otherwise.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure be considered as an example of the principles of the invention and not intended to limit the invention to the specific embodiments shown and described.

Figure 1:
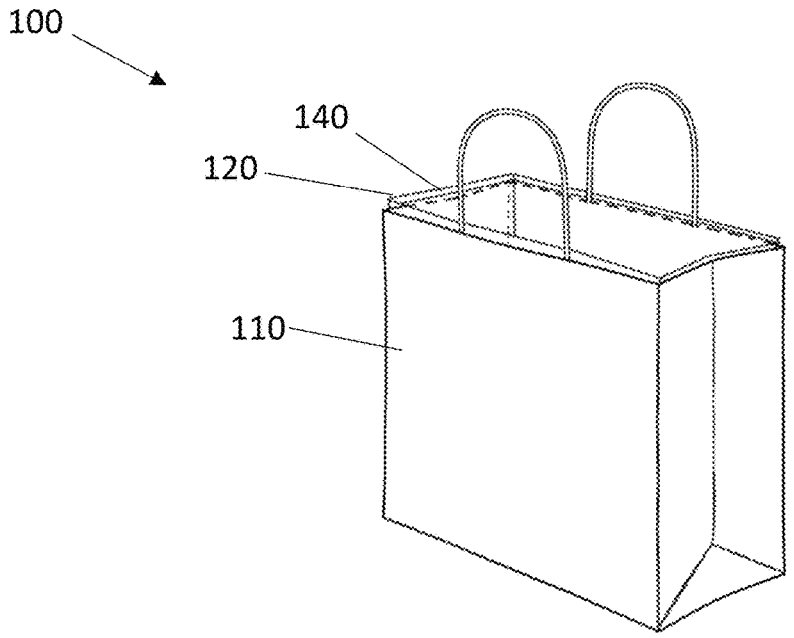
FIG. 1 is a perspective view of a dual-layered food container according to the present invention.
Figure 2:
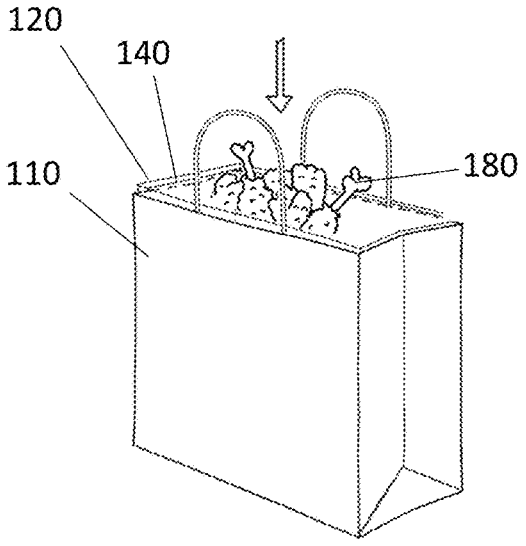
FIG. 2 is a perspective view of the dual-layered food container with prepared food being put into the container.
Figure 3:
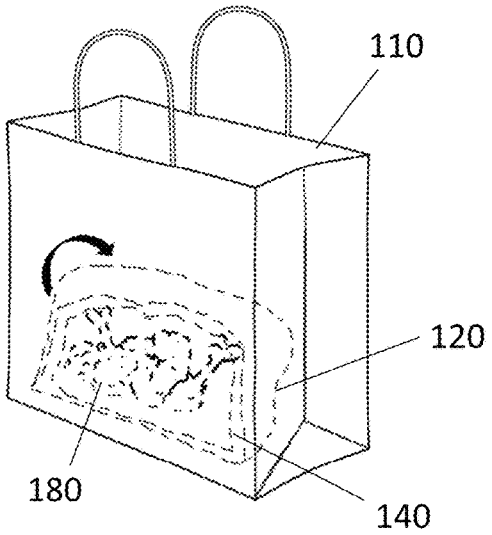
FIG. 3 is a perspective view of the dual-layered food container with prepared food wrapped in the container.

Referring to the drawings of FIGS. 1-9, and more particularly to FIGS. 1-3, there is shown a perspective view of a dual-layered food container 100. The food container 100 includes an outer bag 110 having an inner bag surface and a layer of aluminum foil 130 disposed adjacent the inner bag surface. The aluminum foil 130 includes a first aluminum surface contacting the inner bag surface and a second aluminum surface opposite the first aluminum surface. The food container 100 includes a layer of parchment paper 140 adjacent the second aluminum surface. The layer of aluminum foil 130 extends beyond the layer parchment paper 140 adjacent a top portion of the outer bag 110. The layer of parchment paper 140 prevents food 180 placed in the food container 100 from contacting the aluminum foil 130 during food storage. The aluminum foil 130 extends beyond the parchment paper 140 adjacent a top portion of the outer bag 110. The layer of parchment paper is secured to the layer of aluminum foil with a food grade adhesive. The food grade adhesive may be a water-based adhesive. Alternately, the food container 100 may include dimples disposed on portions of the parchment paper 140, the dimples embedded in the layer of aluminum foil 130 for securing the layer of parchment paper 140 to the layer of aluminum foil 130. The parchment paper 140 may include a flavoring additive or a scent additive for enhancing the food with a barbeque or other popular flavor or scent. In another aspect, the food container includes the aluminum foil 130 and parchment paper 140 without the outer bag so the food container can be inserted into a separately available outer bag.

Figure 10:
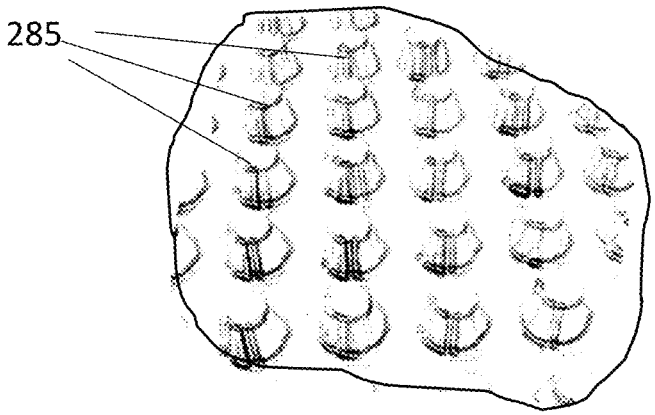
FIG. 10 shows a section of the container having dimples for adhesion of the aluminum foil and the parchment paper.

FIGS. 4-6 show a top front perspective view of a triangular food container 200 including an upper aluminum foil section 210 and a lower aluminum foil section 220, the upper aluminum foil section 210 secured to the lower aluminum foil section 220 along two edges of the upper aluminum foil section 210 and the lower aluminum foil section 220. The triangular food container 200 includes an upper parchment paper section 230 disposed adjacent an upper aluminum foil interior surface and a lower parchment paper section 240 disposed adjacent a lower aluminum foil interior surface. The aluminum foil sections 210, 220 extend beyond the parchment paper sections 230, 240, respectively. The upper parchment paper section 230 and the lower parchment paper section 240 prevent food placed in the triangular food container 200 from contacting the upper aluminum foil section 210 and the lower aluminum foil section 220. The aluminum foil edges along the opening of the triangular food container 200 are folded together to form a seal 290 the prepared food 280 in the container, wherein the parchment paper sections 320, 320' being the only part of the food container sheets 300. 300' to contact the prepared food 380. The upper parchment paper section 230 and the lower parchment paper section 240 may be secured to the upper aluminum foil section 210 and the lower aluminum foil section 22, respectively, with a food grade adhesive 275. The food grade adhesive 275 may be a water-based adhesive. In an alternate embodiment of an adhesion of the parchment paper and the aluminum foil shown in FIG. 10, the triangular food container 200 include securing dimples formed in the aluminum foil and parchment paper layers or in the aluminum foil and parchment paper sections for securing the layers or sections together. Upper dimples disposed on portions of the upper parchment paper section 230 engage the dimples that are embedded in the upper aluminum foil interior surface and lower dimples disposed on portions of the lower parchment paper section 240 engage the lower dimples embedded in the lower aluminum foil interior surface. The upper parchment paper section and the lower parchment paper section may include a flavoring additive or a scent additive.

A dual-layered food container alternately includes an upper aluminum foil section and a lower aluminum foil section, the upper aluminum foil section secured to the lower aluminum foil section along at least two edges of the upper aluminum foil section and the lower aluminum foil section. The dual-layered food container includes an upper parchment paper section disposed adjacent an upper aluminum foil interior surface and a lower parchment paper section disposed adjacent a lower aluminum foil interior surface. The dual-layered food container includes a container opening disposed along an edge portion of the upper aluminum foil section and the lower aluminum foil section. The upper aluminum foil section and the lower aluminum foil section are sealable by folding the edge portions of the upper aluminum foil section and the lower aluminum foil section together. The layer of parchment paper prevents food placed in the triangular food container from contacting the aluminum foil during food storage. The aluminum foil extends beyond the parchment paper along a third edge of the upper aluminum foil section and the lower aluminum foil section. The layer of parchment paper is secured to the layer of aluminum foil with a food grade adhesive. Folding the third edge of the upper aluminum foil section and the lower aluminum foil section secures the dual-layered food container in a closed sealed position. The dual-layered food container may include upper dimples disposed on portions of the upper parchment paper section the upper dimples embedded in the upper aluminum foil interior surface and lower dimples disposed on portions of the lower parchment paper section the lower dimples embedded in the lower aluminum foil interior surface.

Figure 7:
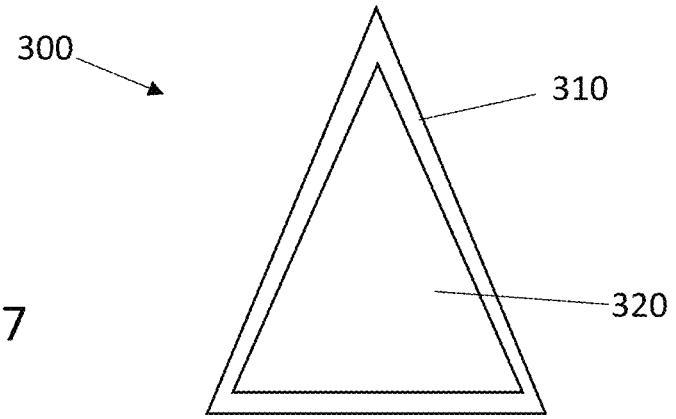
FIG. 7 is a top plan view of a third embodiment of the dual-layered container.
Figure 8:
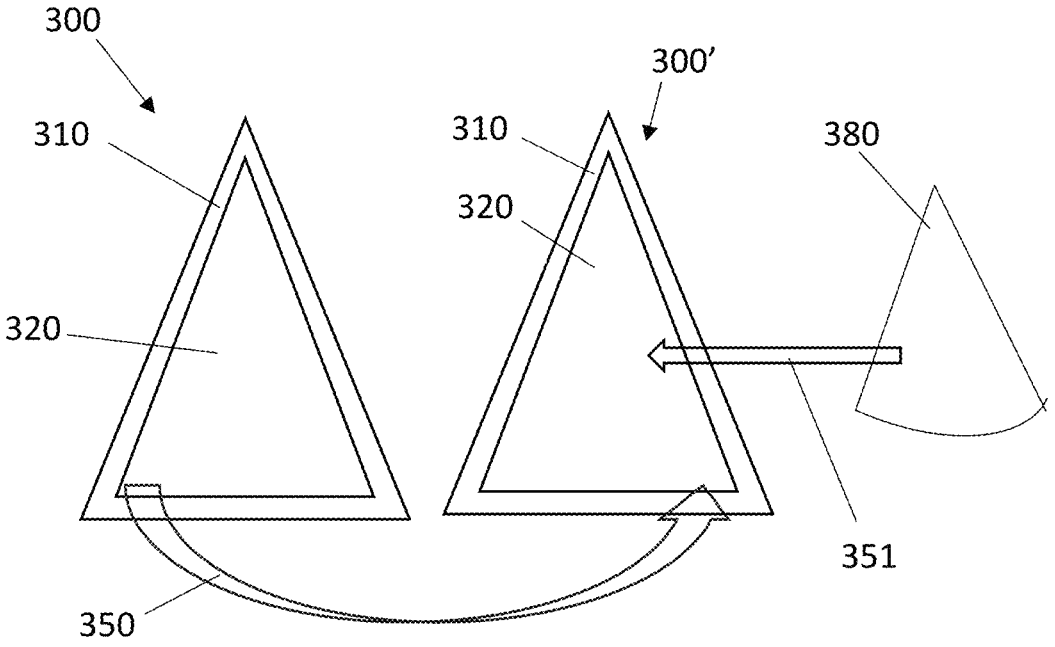
FIG. 8 is a top plan view of a prepared food being place in the dual-layered food container.

In another aspect of the invention shown in FIGS. 7-8, a food container sheet 300 may be used in combination with another food container sheet 300' to provide a container for a prepared food item 380. A first food container sheet 300 includes an aluminum foil section 310 secured to a parchment paper section 320 by adhesive or dimples as previously described. A second food container sheet 300' includes an aluminum foil section 310 secured to a parchment paper section 320 by adhesive or dimples. The prepared food 380 is placed 351 on one of the first food container sheet 300 or the second food container sheet 300' and covered 250 with the opposite sheet. The aluminum foil edges of each of the first food container sheet 300 and the second food container sheet 300' are folded together to seal the prepared food in the container, wherein the parchment paper sections 320, 320' being the only part of the food container sheets 300. 300' to contact the prepared food 380.

Figure 9:
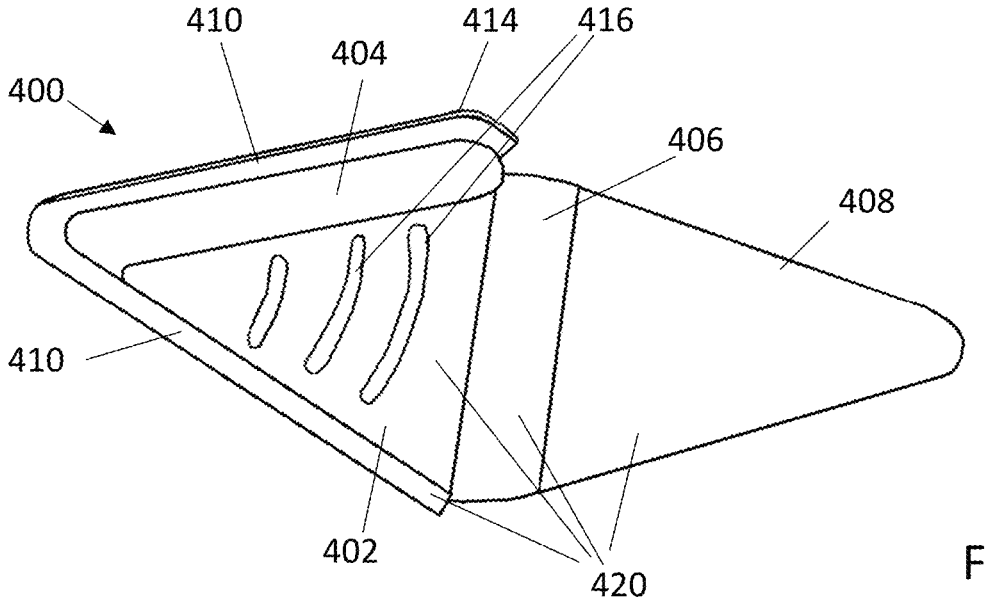
FIG. 9 shows a top perspective view of fourth embodiment of the dual-layer food container.

FIG. 9 shows a top perspective view of fourth embodiment of the dual-layer food container 400. The dual-layer food container 400 is a pre-formed aluminum container having a bottom portion 402 and sides 404 attached to the edges of the bottom portion 402. The dual-layer food container 400 includes a wide hinged portion 406 allowing closure of a lid 408. A foil seam 410 and a seam lip 414 may be used to secure and seal the dual-layer food container 400 with the lid 408 engageable between the seam 410 and a seam lip 414 when the seam lip is folded over the edges of the closed lid 408. Strengthening ribs 416 allow the bottom portion 402 to support the food item placed inside the dual-layered food container 400. Parchment paper 420 coats the interior surface of the bottom portion 402, sides 404, hinged portion 406 and lid 408 of the dual-layer food container 400 so that prepared food placed inside does not contact the aluminum foil. The dual-layer food container 400 may be in a triangular shape or any other shape. The parchment paper 420 is secured to the bottom portion 402, sides 404, hinged portion 406 and lid 408 with an adhesive, dimples or any method which allows for the parchment paper to remain in place.

The food wrap, which is composed of two layers. The first layer is parchment paper, and the second layer is an aluminum foil. The parchment paper layer may be on one surface of the wrap, and the aluminum foil layer may be on the opposite surface. This dual-layer composition of the food wrap may serve a specific purpose. The parchment paper layer may prevent the food from coming into direct contact with the aluminum foil layer. This is because aluminum foil has been known to potentially affect the health benefits or health dangers of a food that the aluminum comes in contact with. Therefore, by securing the aluminum foil to the parchment paper, the food wrap may allow the moldability of aluminum foil but keeps the aluminum foil from touching the food. This arrangement may further protect the food from aluminum leaching into and adhering to food where a consumer will ingest the food having the aluminum residual or food which has reacted to the aluminum foil.

Further expanding on the versatility of the food wrap, it may take various forms to suit different scenarios. For instance, the food wrap may be in the form of a pocket. This pocket form may be particularly useful for enclosing food items, providing a secure and protective environment for the food. The pocket form may also facilitate easy handling and transportation of food items.

The food wrap may be in the form of a bag. The bag form may offer a larger capacity, making it suitable for storing or transporting larger quantities of food. The bag form may also provide a secure seal, potentially enhancing the freshness and longevity of the food stored within.

The food wrap may also be in the form of sheets. The sheet form may offer flexibility in terms of size and shape, as it can be cut or folded to fit various food items and containers. The sheet form may also be convenient for wrapping around food items, providing a protective layer that may prevent direct contact with the aluminum foil.

Regardless of the form, the food wrap may continue to exhibit the characteristic of the aluminum foil side grabbing or engaging with any pan, pot, or container. This feature may enable the food wrap to secure a tight grip, thereby facilitating a seal that may be beneficial during cooking or storage processes. The parchment paper, being near the food, may serve as a barrier between the food and the aluminum foil, potentially enhancing the cooking, heating, and storage of food.

The food wrap may be employed to protect pizza or other similarly shaped food items. The food wrap may be shaped into a triangle, which may be particularly useful in a pizza establishment. This triangle shape may replace a box when one or several slices are left over. This application of the food wrap may offer a cost-effective and space-saving solution for takeout services. The triangle-shaped food wrap may prevent the foil from freezing to the pizza and then sticking to the foil when one wants to reheat. It may also provide a better barrier against freezer burn with the dual-layer protection.

In some variations, the food wrap may be used for home use as single and multi-use bags. These bags may prevent the foil from freezing to the pizza and then sticking to the foil when one wants to reheat. It may also provide a better barrier against freezer burn with the dual-layer protection. The food wrap may also be used to freeze many items for home and commercial use, using the dual layer of foil and parchment. This application of the food wrap may offer a convenient and efficient solution for food storage and preservation.

The food wrap may be utilized for single and multi-use bags, particularly for home use. In such scenarios, the food wrap may serve a specific function of preventing the foil from freezing to pizza and then sticking to the foil when one wants to reheat. This characteristic of the food wrap may offer a convenient solution for reheating leftover pizza, potentially enhancing the user's experience.

In addition to this, the food wrap may provide a better barrier against freezer burn with the dual-layer protection. The parchment paper layer, being near the food, may serve as a barrier between the food and the aluminum foil. This arrangement may potentially enhance the preservation of food, reducing the risk of freezer burn. The aluminum foil layer, on the other hand, may provide a tight seal, potentially enhancing the freshness and longevity of the food stored within.

These operational aspects of the food wrap may offer flexibility and convenience in its application, potentially enhancing food storage, reheating, and cooking experiences. The pocket, bag or sheet continues to exhibit these characteristics, thereby offering a versatile solution for various food-related scenarios.

Further operational use of the food wrap may include freezing a variety of items for both home and commercial use. The dual-layer composition of the food wrap, comprising of parchment paper and aluminum foil, may be particularly beneficial in this context. The parchment paper layer, being in proximity to the food, may serve as a barrier between the food and the aluminum foil. This arrangement may potentially enhance the preservation of food, reducing the risk of freezer burn. The aluminum foil layer, on the other hand, may provide a tight seal, potentially enhancing the freshness and longevity of the food stored within.

In some variations, the food wrap may be used to freeze items such as vegetables, fruits, meat, fish, baked goods, and prepared meals, among others. The food wrap may be cut or folded to fit the size and shape of these items, providing a protective layer that may prevent direct contact with the aluminum foil. This feature may be particularly beneficial in preserving the nutritional value of the food items, as it may prevent the aluminum from leaching into the food.

Aluminum foil has been known to adversely affect the health benefits or health dangers of a food that the aluminum comes in contact with. By securing the aluminum foil to the parchment paper, the wrap allows the moldability of aluminum foil but keeps the aluminum foil from touching the food. The foil portion allows for a tight seal when securing the food wrap to a rim of a container or to grab and hold a pan or bowl or other cooking or baking or storage container. Also, the food is further protected from aluminum leaching into and adhering to food where a consumer will ingest the food having the aluminum residual or food which has reacted to the aluminum foil. The different sizes, and shapes and container to adapt this method will save and enhance foods storage and reheating and cooking.

Advantages are that the food wrap protects food from direct contact with aluminum contained in the food wrap. The food wrap may also enhance cooking, heating and storage of food.

Since many modifications, variations, and changes in detail can be made to the described embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

In addition, the present invention has been described with reference to embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

Although very narrow claims are presented herein, it should be recognized that the scope of this invention is much broader than presented by the claim. It is intended that broader claims will be submitted in an application that claims the benefit of priority from this application.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A triangular food container, comprising:

an upper aluminum foil section and a lower aluminum foil section, the upper aluminum foil section secured to the lower aluminum foil section along two edges of the upper aluminum foil section and the lower aluminum foil section;

an upper parchment paper section disposed adjacent an upper aluminum foil interior surface;

a lower parchment paper section disposed adjacent a lower aluminum foil interior surface; and upper dimples disposed on portions of the upper parchment paper section the upper dimples embedded in the upper aluminum foil interior surface and lower dimples disposed on portions of the lower parchment paper section the lower dimples embedded in the lower aluminum foil interior surface;

wherein the upper aluminum foil section and the lower aluminum foil section extend beyond the upper parchment paper section and the lower parchment paper section, respectively; and wherein the upper parchment paper section and the lower parchment paper section prevent food placed in the triangular food container from contacting the upper aluminum foil section and the lower aluminum foil section.

2. The triangular food container of claim 1 wherein the upper parchment paper section and the lower parchment paper section are secured to the upper aluminum foil section and the lower aluminum foil section, respectively, with a food grade adhesive.

3. The triangular food container of claim 2 wherein the food grade adhesive is a water-based adhesive.

4. The triangular food container of claim 1 wherein the upper parchment paper section and the lower parchment paper section include a flavoring additive.

5. A dual-layered food container, comprising:

an upper aluminum foil section and a lower aluminum foil section, the upper aluminum foil section secured to the lower aluminum foil section along at least two edges of the upper aluminum foil section and the lower aluminum foil section;

an upper parchment paper section disposed adjacent an upper aluminum foil interior surface;

a lower parchment paper section disposed adjacent a lower aluminum foil interior surface;

a container opening disposed along an edge portion of the upper aluminum foil section and the lower aluminum foil section; and upper dimples disposed on portions of the upper parchment paper section the upper dimples embedded in the upper aluminum foil interior surface and lower dimples disposed on portions of the lower parchment paper section the lower dimples embedded in the lower aluminum foil interior surface;

wherein the upper aluminum foil section and the lower aluminum foil section are sealable by folding the edge portions of the upper aluminum foil section and the lower aluminum foil section together; and wherein the layer of parchment paper prevents food placed in the dual-layered food container from contacting the aluminum foil during food storage.

6. The dual-layered food container of claim 5 wherein the upper aluminum foil section and the lower aluminum foil section extend beyond the upper parchment paper section and the lower parchment paper section, respectively, along a third edge of the upper aluminum foil section and the lower aluminum foil section.

7. The dual-layered food container of claim 5 wherein the upper parchment paper section and the lower parchment paper section are secured to the upper aluminum foil section and the lower aluminum foil section, respectively with a food grade adhesive.

8. The dual-layered food container of claim 7 wherein folding the third edge of the upper aluminum foil section and the lower aluminum foil section secures the dual-layered food container in a closed sealed position.

9. A food container, comprising:

an upper aluminum foil section and a lower aluminum foil section, the upper aluminum foil section secured to the lower aluminum foil section along two edges of the upper aluminum foil section and the lower aluminum foil section;

an upper parchment paper section disposed adjacent an upper aluminum foil interior surface; and a lower parchment paper section disposed adjacent a lower aluminum foil interior surface;

wherein the upper aluminum foil section and the lower aluminum foil section extend beyond the upper parchment paper section and the lower parchment paper section, respectively;

wherein the upper parchment paper section and the lower parchment paper section prevent food placed in the food container from contacting the upper aluminum foil section and the lower aluminum foil section; and wherein the upper parchment paper section and the lower parchment paper section include a scent additive.

* * * * *